United States Patent [19]

Shinn et al.

[11] Patent Number: 4,945,657

[45] Date of Patent: Aug. 7, 1990

[54] ROTARY DRUM DRYER WITH IMPROVED PREMIXING ASSEMBLY

[75] Inventors: Donald E. Shinn; Andrew D. Livingston, both of Independence, Kans.

[73] Assignee: Productization, Inc., Independence, Kans.

[21] Appl. No.: 398,837

[22] Filed: Aug. 23, 1989

[51] Int. Cl.[5] ..... F26B 3/10

[52] U.S. Cl. ..... 34/128; 34/129; 34/136; 432/118

[58] Field of Search ..... 432/105, 109, 110, 118; 34/128, 130, 108

[56] References Cited

U.S. PATENT DOCUMENTS

| | | | |
|---|---|---|---|
| 4,338,732 | 7/1982 | Coxhill | 432/118 |
| 4,427,376 | 1/1984 | Etnyre et al. | 432/110 |
| 4,729,176 | 3/1988 | Shinn et al. | 34/128 |

*Primary Examiner*—Henry C. Yuen

*Attorney, Agent, or Firm*—Hovey, Williams, Timmons & Collins

[57] ABSTRACT

An improved multiple-pass drum dryer (12) is provided which includes an enlarged, flighted premixing zone (65) including a frustoconical, converging transition section (68) leading to an innermost passageway (138) of a concentric multiple-pass final drying section (24). Product and drying air fed to the premixing zone (65) undergo an acceleration in the transition section (68), whereupon product and air are decelerated during travel through the multiple-pass final drying section (24). In this way, product is moved along a first region (66) of the premixing zone (65) at a relatively low average speed so that the initially wet product is proximally exposed to heated gases emitted from a burner for a maximally effective time period. The product then experiences a relatively rapid acceleration in the transition section (68) due to negative pressure from a downstream fan and decreasing cross-sectional area in the transition section (68). In preferred embodiments ambient-air injecting ports (154) are provided for propelling the product along the final pass in the outermost passageway (148) of the final drying section (24).

12 Claims, 3 Drawing Sheets

ROTARY DRUM DRYER WITH IMPROVED PREMIXING ASSEMBLY

BACKGROUND OF THE INVENTION

1. Field of the Invention

The present invention relates to an improved multiple-pass product treating device useful for drying a variety of particulates such as wood furnish and agricultural products. More particularly, it is concerned with such a device which achieves substantially increased efficiency through the use of an internal flow path arrangement serving to direct incoming initially wet product through a premixing zone at a relatively slow speed and thence along a serpentine flow path beginning in an innermost relatively small cross-sectional area and proceeding to passageways of successively larger cross-sectional areas until dried product is removed from the apparatus.

In other aspects of the invention, apparatus is provided for the introduction of relatively dry ambient air into the outermost dryer drum to reduce the partial pressure of water vapor of the air currents passing through the dryer to increase final stage drying in the apparatus.

In this fashion the velocity of air currents within the device is first increased and then decreased as the currents pass therein, whereby the velocity differential between such air currents and the saltation velocities of the particles being dried is maintained for maximum drying effect.

2. Description of the Prior Art

The drying of wood or agricultural particulates in a multi-stage dryer is dependent upon a large number of factors, e.g. the type of product to be dried, the initial moisture content thereof, particle geometry, variable ambient conditions, dryer configuration and fuels being employed.

In general, however, the drying process involves several distinct phases or stages. That is to say, most hygroscopic materials exhibit several distinct drying rate periods as they pass through a multi-pass dryer. Initial drying is accompanied by a warming of the material and its attendant moisture. The drying rate increases during this initial period, while the moisture content drops to a value which signals the beginning of a constant rate period of drying. During the constant rate period moisture is evaporated from the surface of product particles at a steady rate until the surfaces are no longer entirely wet. Thereafter, a falling-off period obtains where the drying rate decreases because of the increasing difficulty of moving internal product moisture to the particle surfaces where it can be taken up and moved away. Finally, the product moisture is reduced to a point where an equilibrium is established with the surrounding atmosphere.

Conventional three-pass dryers include an elongated horizontal, axially rotatable body having an outer drum and a series of concentric smaller diameter drums within the outer drum. The drums are in communication with each other and define a serpentine flow path within the dryer. Such dryers are provided with a product inlet oriented for directing initially wet product and hot drying air into the innermost, smallest diameter drum, whereupon the product is conveyed via induced draft current through the outer drum until it reaches a passageway defined by the outer drum and the next inboard drum. At this point the product is in its final fried condition and is delivered for further handling or collection. Thus, conventional three pass cylindrical dryers utilize comparatively high air velocities and temperature conditions in the innermost drum (first pass) where the incoming products are the heaviest and the wettest. Lower air velocities and lower temperatures obtain in the intermediate drum (second pass), and even lower velocities and temperatures exist in the outer drum (third pass). In practice, however, the relatively high air current velocity conditions in the first pass of a conventional dryer cause the wet product particles to be quickly driven away from the heat source, and there is consequently a reduced opportunity for adequate heat transfer and evaporation. In subsequent passes with lower air current velocities, the particles may settle out because the prevailing air current velocities fall below the saltation velocity of the product (i.e. the minimum air current velocity needed to pick up and convey product at a given moisture level). Thus, plugging of the dryer may occur, particularly at high product flow rates, and at best the product only moves at a rate determined by the forward velocity of the slowest moving (largest) particles. The result is that the flow rate is decreased and this inevitably has an adverse effect on drying efficiency.

SUMMARY OF THE INVENTION

The present invention overcomes the problems described above and provides a unique device construction and method providing high drying efficiencies and the consequent ability to dry relatively large quantities of product in a small dryer utilizing reduced amounts of fuel. Broadly speaking, a multiple-pass device of the invention provides a premixing zone having a relatively large effective cross-sectional area into which initially wet product is introduced and thence passed into the multiple-drum portion of the invention, whereupon the product and attendant air currents pass outwardly through drums of successively larger effective cross-sectional areas, so that the product exits from the largest diameter outer drum.

In more detail, the preferred dryer includes an elongated, normally horizontally disposed, axially rotatable body having means defining a plurality of elongated internal passageways in communication with each other to present a continuous serpentine flow path through the body. Advantageously, these passageways are substantially concentric and each presents a different effective cross-sectional area. A product inlet is oriented for initially directing product to be dried into a premixing zone having a relatively large effective cross-sectional area. Further, means is provided for creating currents of heated air within the body and along the flow path for conveying the product along the flow path through the premixing zone, and then toward and through the relatively small effective cross-sectional area passageways.

In other aspects of the invention, means is provided for introducing quantities of relatively dry, ambient derived air into the outermost passageway of the dryer body, so as to lower the partial pressure of water within the air currents traveling through the dryer, thus enhancing the final stages of drying.

Preferably an elongated, rotatable conical element is concentrically disposed between the premixing zone and a division plate which divides the premixing zone from the portion of the dryer containing the serpentine passageways. Air-directing ports are located at the entrance of the outer drum so as to direct the ambient derived air into and along the length of the passageway defined by the intermediate drum and outer drum (third pass). The air is first admitted through ports located in the outer surface of the body.

In practice, dryers in accordance with the present invention achieve measurably increased efficiencies. These are obtained in part by virtue of the relatively large premixing zone which serves to provide a sufficiently large volume to effect a relatively rapid transfer of moisture from the product to be dried to the drying atmosphere and a relatively rapid transfer of energy from the drying gases to the removed moisture in the form of the heat of vaporization. The drying gases, vapor laden and thoroughly reduced in temperature, then can cause no adverse effect upon the product once both gases and product enter the serpentine passageway portion of the dryer. Also, plugging of the dryer cannot occur due to introduction of ambient air in the outermost passageway of the serpentine portion of the device, thereby helping to propel the dried product from the dryer.

DESCRIPTION OF THE PREFERRED EMBODIMENT

Figure 1:
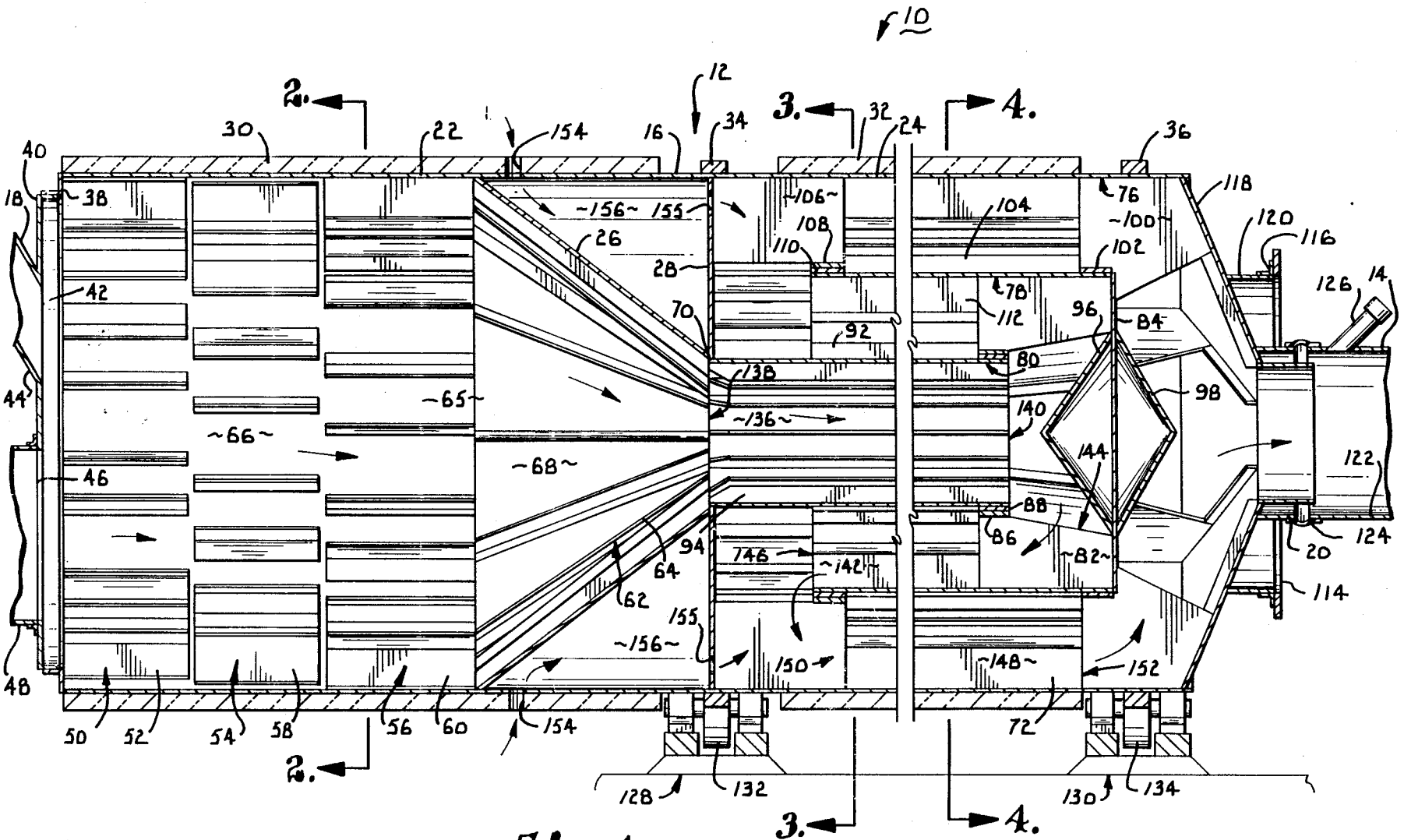
FIG. 1 is a fragmentary view in partial vertical section illustrating the multiple-pass product treating device in accordance with the present invention.

The present invention is essentially a drying system or multiple-pass product treating device, the essential aspects of which are shown in FIG. 1 of the drawings. A fuller understanding of the dryer of the invention, in the context of a complete drying system, including an upstream burner and product inlet feeder, and a downstream fan and cyclone separator assembly, can be had through a study of U.S. Pat. No. 4,729,176, incorporated by reference herein.

Referring now to the drawings of the present application in general, and FIG. 1 in particular, a drying system 10 is partially illustrated, broadly including a dryer assembly 12, with an upstream burner and feeder (not shown) for respectively supplying hot drying air and initially wet product to the dryer assembly 12. In addition, system 10 includes a downstream cyclone separator assembly (not shown) having an induced draft fan unit (not shown) and a conduit 14 leading from the outlet of dryer 12 to the inlet of the separator assembly.

More particularly, dryer assembly 12 includes an elongated, normally horizontally disposed, axially rotatable body 16, product inlet structure 18 and product outlet structure 20. Body 16 includes aligned shell sections 22 and 24. Body 16 further includes connecting member 26 and dividing wall 28.

Each of the sections 22, 24 is covered by external thermal insulation as at 30, 32. Element section 24 is provided with a pair of laterally spaced apart, outwardly extending metallic tracks 34, 36, the function of which will be described below.

The left-hand or inlet end of section 22 is provided with an endmost flange 38. A stationary circular head 40 is received within flange 38 as illustrated and covers the inlet end of section 22. Inlet structure 18 is secured to head 40 and communicates with inlet opening 42, and includes upwardly and obliquely extending product inlet chute 44. Moreover, head 40 includes a lower circular inlet opening 46 for the introduction of heated drying air into the drum assembly 12. For this purpose, a tubular collar-type connector 48 is affixed to head 40 in registry with opening 46, and is designed to mate with the outlet of the burner (not shown).

Figure 2:
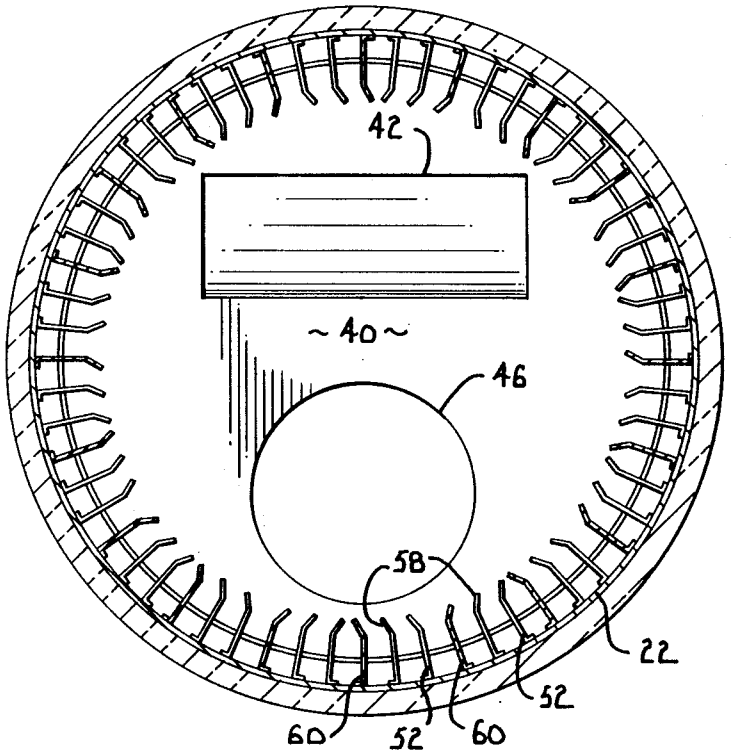
FIG. 2 is a sectional view taken along line 2—2 of FIG. 1.

Section 22 is provided with three series of laterally adjacent, circumferentially spaced apart internal flights. Referring particular to FIGS. 1 and 2, it will be seen that a series 50 of flights is provided adjacent head 40 and includes a plurality of inwardly extending flight members 52 spaced about the interior of section 22. In a similar fashion, flighting series 54 and 56 are provided, respectively having circumferentially spaced apart, inwardly extending flighting elements 58 and 60. The purpose of the internal flightings within premixing zone structure 26 is to initially separate and "shower" incoming, initially wet product to the drum assembly 12.

Connecting member 26 has an additional series 62 of flights including a plurality of inwardly extending flight members 64 attached to the interior thereof. The volume defined from the inlet end of section 22 to the right-hand end of connecting member 26 is denominated premixing zone 65. Premixing zone 65 is subdivided into two volumes the first of which runs from head 40 to the right end of series 56 and is denominated as a first region 66 of premixing zone 65. The second volume associated with premixing zone 65 runs along the flight members 64 and is denominated as a second region or transition section 68. It will be observed that the second region 68 is conical in shape due to the defining walls of connecting members 26. The right end or second end of second region 68 of premixing zone 65 terminates in an aperture 70.

Figure 3:
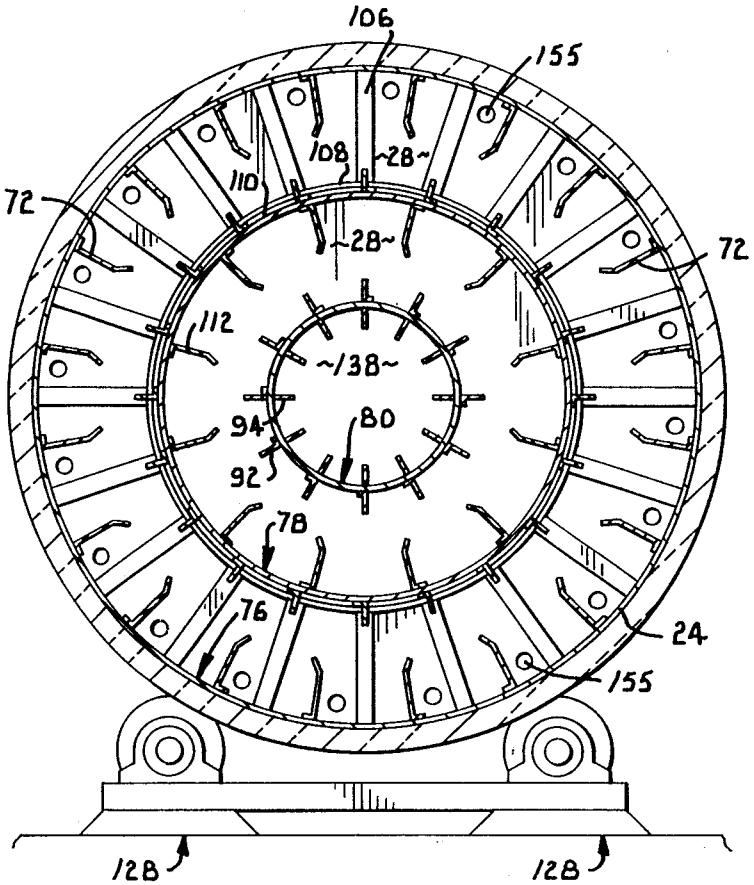
FIG. 3 is a sectional view taken along line 3—3 of FIG. 1.
Figure 4:
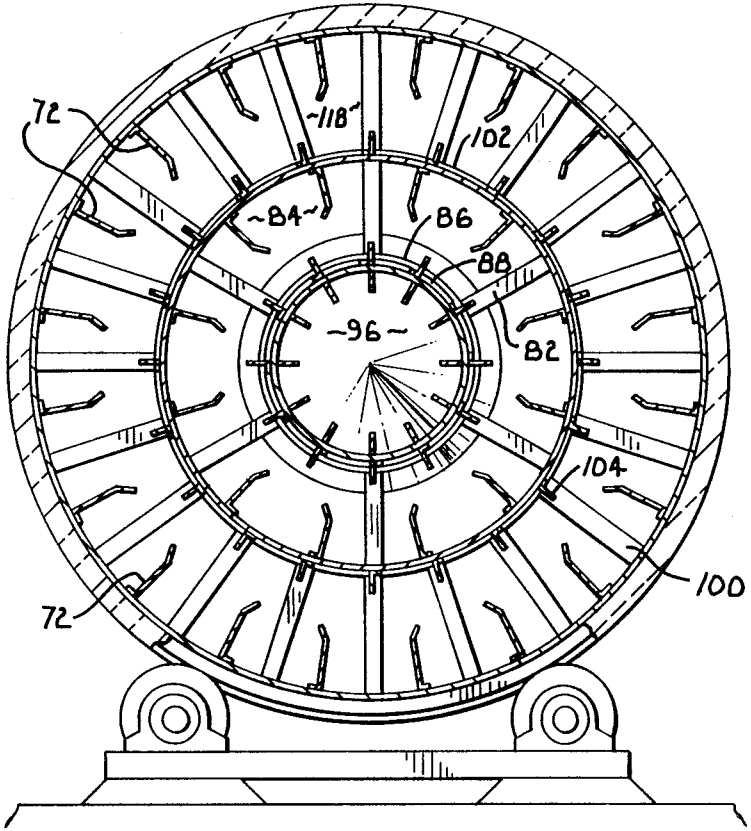
FIG. 4 is a sectional view taken along line 4—4 of FIG. 1.

The section 24 has a single series of elongated circumferentially spaced apart, inwardly extending flights 72 which are respectively affixed to the inner face thereof (see FIGS. 1, 3 and 4). Connecting member 26 is connected to section 22 at the first end of second region 68 and attached to dividing wall 28 at the second end of region 68.

Section 24 includes outermost drum 76, intermediate drum 78 and innermost drum 80. Drums 76–80 are concentric and of increasing effective cross-sectional area from innermost to outermost.

Innermost drum 80 is in the form of a tubular metallic body extending substantially the length of the section 24 as illustrated in FIG. 1.

Drum 80 is supported adjacent the right-hand end of drum assembly 12, as seen in FIG. 1, by means of plural, circumferentially spaced, radially outwardly extending struts 82. These struts 82 are welded to end wall 84 and drum 78 as shown and extend outwardly therefrom. The inboard ends of the struts 82 are also welded to a circular ring 86 which is situated adjacent the interface of mounting ring 88. However, there is no interconnection between the rings 86, 88, in order to accommodate thermal expansion and contraction of the components making up the drum assembly 12.

The left-hand end of drum 80 is supported by dividing wall 28 which also demarcates section 22 from section 24. The outer face of drum 80 carries a plurality of reinforcing angle ribs 92 which extend between the struts 82 and dividing wall 28 as depicted. These ribs 92 are oriented in an evenly circumferentially spaced fashion about drum 80. The inner face of drum 80 has a series of lifting and separating flights 94 which are oriented in circumferentially spaced relationship and extend inwardly toward the center of drum assembly 12. Also, the inner circular margin of dividing wall 90 is affixed to drum 80 as illustrated.

Intermediate drum 78 is in the form of an elongated, circular in cross-section metallic element extending essentially the axial length of member 24; but of a smaller diameter. Dividing wall 28 serves as the left-hand end of drum 78 as seen in FIG. 1. End wall 84, attached opposite, is provided with a central conical element 96 thereof. End wall 84 further has a conical element 98 affixed to the face thereof remote from head 40 and extending toward the opposite end of the drum assembly 12.

Intermediate drum 78 is supported within the drum defining member 24 by means of a plurality of radially extending, circumferentially spaced apart struts 100 located adjacent the right-hand end of the drum 78 as viewed in FIG. 1. In particular, it will be seen that a circular reinforcing plate 102 is secured to the extreme right-hand end of the drum 78, with the struts 100 being welded to and extending radially outwardly from plate 102. The outboard ends of the struts 100 are welded to the interface of section Z4. In order to provide further strength and rigidity, elongated, axially extending angle ribs 104 are affixed to the outer face of drum 78 and are oriented in a circumferentially spaced relationship (see FIG. 4). In this respect it will be noted that the ribs 104 are oriented with the struts 100.

The opposite end of drum 78 adjacent dividing wall 28 is likewise supported by means of radially outwardly extending, circumferentially spaced apart struts 106. These struts are welded to dividing wall 28 and section 24 as shown and extend outwardly therefrom. The inboard ends of the struts 106 are also welded to a circular ring 108 which is situated adjacent the inner face of mounting ring 110. However, there is no inner connection between the rings 108, 110, in order to accommodate thermal expansion and contraction of the components making up the drum assembly 12. The innerface of drum 78 has a series of lifting and separating flights 112 which are oriented in circumferentially spaced relationship and extend inwardly toward the center of drum assembly 12.

Outermost drum 76 is substantially coterminus with section 24. The right-hand end of drum 76 terminates at the beginning of product outlet structure 20. Surrounding outlet structure 20 is a drive sprocket 114 having a reinforcing angle 116 bolted thereto. Angle 116 is secured by means of welding to the ring 120, in order to rotate a sleeve ring 120 and, by virtue of the described interconnections, the entirety of drum assembly 12. For this purpose, the device 10 includes a chain (not shown) trained around sprocket 114, with the chain being operatively coupled to a drive motor (not shown).

As stated above, the extreme right-hand end of drum 76 terminates adjacent outlet structure 20; structure 20 in turn is connected to conduit 14 which includes a stationary plenum box 122 as viewed in FIG. 2. Box 122 includes a heavy drop-out chute (not shown) Further, a flexible seal 124 is provided between the product outlet structure 20 and the inlet of stationary box 122 to effect a rotating seal between these members.

Finally, box 122 is equipped with a water injection port 126 so as to permit selective injection of moisture into air currents within plenum box 122. The complete dryer assembly 12 is mounted for axial rotation by means of a pair of mounting assemblies 128, 130 respectively located beneath the tracks 34, 36. Each of the mounting assemblies 128, 130 includes a pair of spaced apart, axially rotatable trunnions 132 and 134. The trunnions 132, 134 are respectively in engagement with the tracks 34, 36. From the foregoing discussion, it will be appreciated that the overall drum assembly 12 presents an elongated, normally horizontally disposed, axially rotatable body 16 with appropriate portions of section 22 and connecting member 26 defining an essentially linear flow path and with the drums 76, 78, and 80 cooperatively defining a plurality of internal passageways intercommunicated to present a continuous serpentine flow path, so that from head 40 to outlet structure 20 there is defined a continuous body flow path. In particular, it will be seen that drum assembly 12 includes a first region 66 of premixing zone 65 and a second region 68 which is in fluid communication with an elongated, annular in cross-section innermost flow passageway 136 having an entrance end 138 and an exit end 140, with passageway 136 being defined within drum 80; an elongated, annular in cross-section intermediate passageway 142 having an entrance in 144 and an exit in 146 and being defined between drum 78 and drum 80 and an outermost, circular in cross-section passageway 148 presenting an entrance end 150 and an exit end 152. As will be readily appreciated, provision of section 22 and connecting member 26 and walls 84 and 28 ensures that flow of product and air currents through the drum assembly 12 must proceed serially through the passageways 136, 142, and 148 rather than being short circuited directly to any of the outer passageways.

In general, therefore, product to be dried and induced air currents first pass through first region 66, second region 68, and thence through innermost passageway 136, intermediate passageway 142 and outer passageway 148 before leaving the drum assembly via outlet structure 20. The burner (see incorporated U.S. Pat. No. 4,729,176) is of essentially conventional construction and may be any one of a series of commercially available burners. In general, the burner would include an air inlet leading to a fuel fired burner chamber which communicates with connector 48. One burner useful in the context of the present invention is that sold by Productization Inc. of Independence, Kans.

The cyclone separator assembly (not shown) includes a conventional cyclone separator having an inlet and a lower product outlet. The separator is located at an elevated position, and conduit 14 extends between the plenum box 122 and the inlet, as those skilled in the art will readily appreciate. The fan unit (not shown) is positioned at grade and includes a large industrial fan having an air outlet stack. The inlet to the fan is connected to the upper end of cyclone separator by means of an upright conduit.

In operation, the fan unit serves to draw ambient air into the burner chamber through the inlet whereupon such air is heated and pulled through the previously described internal flow path of the drum assembly 12 in the manner described. Inasmuch as product is simultaneously delivered to dryer assembly 12 (advantageously in a disbursed sheet-like fashion through the large opening 42), it will be appreciated that such product is conveyed through the dryer assembly 12 by means of the induced air currents created by the fan. Furthermore, such negative pressure currents convey dried product from dryer assembly 12 through conduit 14 for ultimate separation in the cyclone separator and later collection.

The described dryer construction gives a number of significant advantages in operation. As is evident from the foregoing, the device 10 first of all provides a body flow path which allows incoming product, to be dried to enter at low velocities and reside in the relatively large premixing zone (particularly the first region 66 thereof) for a sufficient time period to effect a relatively rapid transfer of moisture from the product to be dried to the drying atmosphere and a relatively rapid transfer of energy from the drying gases to the removed moisture in the form of the heat of vaporization. Ports 154 also permit ready introduction of relatively low humidity, ambient-derived air into the outermost dryer passageway 148. Thus, if desired, relatively dry air from the atmosphere may be directed into the entrance end 150 of the passageway 148 via openings 155 (see FIGS. 1 and 3), for mixing with the heated, humid air currents passing therethrough. Inasmuch as a reduction in the humidity of the air stream within passageway 148 causes a corresponding reduction in the partial pressure of the water vapor in the combined air stream, enhanced drying is obtained, because a greater differential vapor pressure between moisture in the product and moisture in the surrounding atmosphere is achieved. It will be noted in this respect that the ambient-derived air is preheated within zone 156, defined by appropriate portions of section 22, connecting member 26 and dividing wall 28, by virtue of indirect heating through connecting member 26. Furthermore, provision of the respective diameters of the openings 155, and ports 154, 148, ensures that such air enters at a substantial velocity and with sufficient turbulence to promote proper mixing between the low humidity ambient air and the relatively high humidity induced air currents, and that the ambient-derived air propels the final dried product from the dryer assembly 12, thereby preventing plugging of material in passageway 148.

We claim:

1. A multiple-pass product treating device comprising:

an elongated, normally horizontally disposed, axially rotatable body having means defining a premixing zone and a plurality of elongated internal passageways intercommunicated to present a continuous, serpentine flow path within said body, there being an innermost passageway and at least one outer passageway, as a part of said flow path, said premixing zone including structure presenting a region of relatively large cross-sectional area and an aperture of relatively small cross-sectional area, said aperture being in fluid communication with the innermost of said passageways;

inlet means defining a product inlet oriented for initially directing product to be treated into said premixing zone;

means defining a product outlet in communication with said outer one of said passageways, said one outer passageway having a larger crosssectional area than said innermost passageway; and means for creating air currents within said premixing zone and along said flow path of said body, for conveying said product in a concurrent fashion with said air currents, from said product inlet to said premixing zone and thence along the flow path into and through said innermost passageway, and then into and through the remainder of said flow path and out said product outlet.

2. The device of claim 1, including means for heating said air currents.

3. The device of claim 1, said passageway-defining means comprising a plurality of elongated, radially concentric drums.

4. The device of claim 1, including flight means within said body and positioned along the length of at least a portion of said flow path for dispersing said product and assisting in the conveyance thereof.

5. The device of claim 1, said air current-creating means including induced draft fan means for inducing airflow within said body and said premixing zone and along said flow path.

6. The device of claim 1, said premixing zone means including inwardly projecting flight structure disposed about the internal periphery thereof.

7. The device of claim 1, said device including a three pass dryer in conjunction with a one pass premixer, said dryer having three substantially concentric drums, said innermost passageway being defined by the innermost drum, the other two drums being external thereto and of progressively greater diameter, there being wall means in covering relationship to the end of said external drums adjacent said premixing zone to prevent direct passage of air and product into said external drums.

8. A multiple-pass product treating device comprising:

an elongated, normally horizontally disposed, axially rotatable body having means defining a premixing zone presenting a generally linear flow path and means defining a plurality of elongated internal passageways, including an innermost passageway, said passageways intercommunicated to present a continuous serpentine flow path, said linear flow path and said serpentine flow path being intercommunicated and oriented to present a contiguous body flow path which presents a flow axis therealong, said premixing zone including structure defining a first region of relatively large average cross-sectional area having a first end and a second end respectively farther from and closer to said passageways, and a second region of relatively small average cross-sectional area, having a first end and a second end respectively farther from and closer to said passageways, said second region being interposed and providing fluid communication between said first region and said innermost passageway, said second region having decreasing cross-sectional area, means operatively coupling said second region-defining structure and said innermost passageway along the flow axis in the direction from said second region first end to said second region second end, defining an aperture interposed and providing communication between said second region and said innermost passageway;

inlet means defining a product inlet oriented for initially directing product to be treated into said premixing zone, said inlet means disposed adjacent and in fluid communication with said first region and distal to said second region;

means defining a product outlet in communication with another of said internal passageways having a relatively larger effective crosssectional area as compared with said innermost passageway, said other passageway being disposed outside of and radially outboard of said innermost passageway; and means for creating air currents along said body flow path, for conveying said product along with said air currents, from said product inlet, within said premixing zone along said linear flow path and thence through said innermost passageway and then into and through said other passageway and finally out said product outlet.

9. The device of claim 8, wherein said first region of said premixing zone is cylindrical in shape and said second region is frustoconical.

10. A multiple-pass product treating device comprising:

an elongated, normally horizontally disposed, axially rotatable body having means defining a premixing zone presenting a generally linear flow path and means defining a plurality of elongated internal passageways, including an innermost passageway, said passageways intercommunicated to present a continuous serpentine flow path, said linear flow path and said serpentine flow path being intercommunicated and oriented to present a contiguous body flow path which presents a flow axis therealong, said premixing zone including structure defining a first region of relatively large average cross-sectional area having a first end and a second end respectively farther from and closer to said passageways, and a second region of relatively small average cross-sectional area, having a first end and a second end respectively farther from and closer to said passageways, said second region being interposed and providing fluid communication between said first region and said innermost passageway, said second region having decreasing cross-sectional area along the flow axis in the direction from said second region first end to said second region second end, there being means operatively coupling said second region-defining structure and said innermost passageway defining an aperture interposed and providing communication between said second region and said innermost passageway;

inlet means defining a product inlet oriented for initially directing product to be treated into said premixing zone, said inlet means disposed adjacent and in fluid communication with said first region and distal to said second region;

means defining a product outlet in communication with another of said internal passageways having a relatively larger effective crosssectional area as compared with said innermost passageway, said other passageway being disposed outside of and radially outboard of said innermost passageway; and means for creating air currents along said body flow path, for conveying said product along with said air currents, from said product inlet, within said premixing zone along said linear flow path and thence through said innermost passageway and then into and through said other passageway and finally out said product outlet, said air current means including structure for introducing ambient air into said other passageway.

11. The device of claim 10, wherein said ambient air structure of said air current means defines a chamber exterior to said premixing zone, said chamber having at least one port or introduction of ambient air thereinto and further having at least one orifice axially spaced apart from said port and in fluid communication with said other passageway.

12. The device of claim 11, wherein the diameter of said orifice is sufficiently small so that the velocity of air entering said other passageway through said orifice is relatively fast.

* * * * *